US005280920A

United States Patent [19]

Knapper, II

[11] Patent Number: 5,280,920

[45] Date of Patent: Jan. 25, 1994

[54] PORTABLE TARGET SYSTEM

[76] Inventor: William J. Knapper, II, 5354 East Comstock Ave., Kalamazoo, Mich. 49001

[21] Appl. No.: 939,121

[22] Filed: Sep. 3, 1992

[51] Int. Cl.[5] ..... F41J 1/10

[52] U.S. Cl. ..... 273/407

[58] Field of Search ..... 273/407, 408, 409, 410, 273/348, 353, 398, 400, 401, 402, 403, 404

[56] References Cited

U.S. PATENT DOCUMENTS 2,691,526 10/1954 Wesley et al. ..... 273/407 X
3,088,738 5/1963 Meyer ..... 273/404
3,743,286 7/1973 Weinhagen et al. ..... 273/407 X

*Primary Examiner*—William H. Grieb
*Attorney, Agent, or Firm*—Joseph K. Andonian

[57] ABSTRACT

A portable, reusable, disposable, compact package that opens up and reconnects to form an upright target and sight-in system for guns.

4 Claims, 1 Drawing Sheet

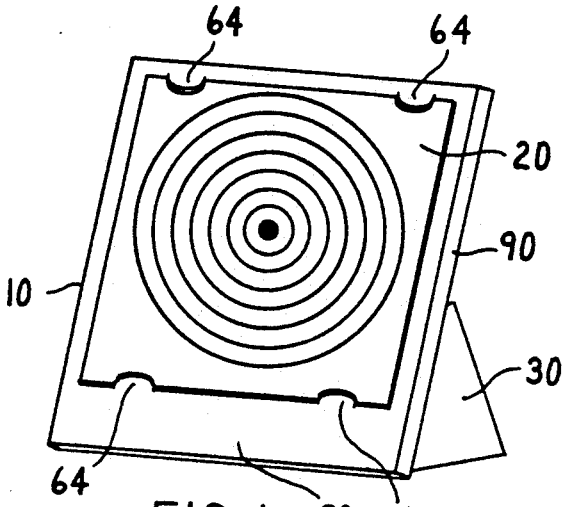
FIG. 1
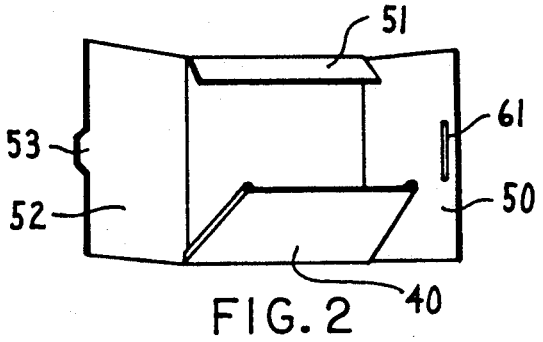
FIG. 2
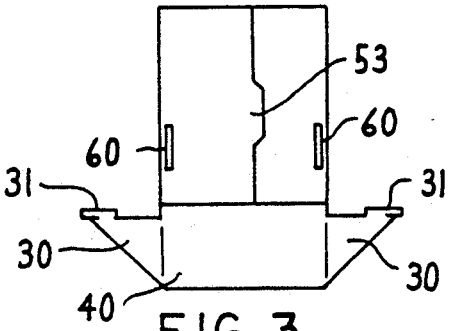
FIG. 3
FIG. 4
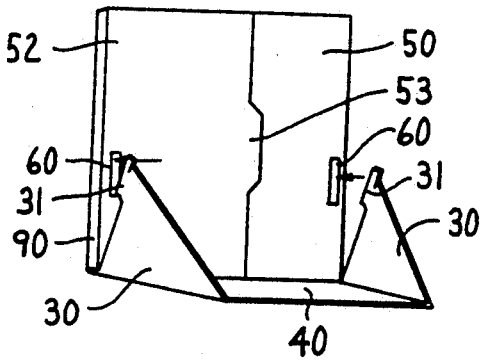
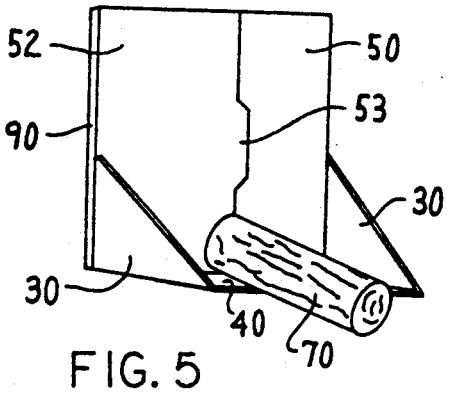
FIG. 5

PORTABLE TARGET SYSTEM

FIELD OF INVENTION

This invention relates to a compact, portable package capable of functioning as a target and sight-in system.

BACKGROUND OF INVENTION

There are many products on the market that are sold for target practice and/or a sight check when a hunter is miles away from a target range. These products are generally expensive to buy, bulky to carry and/or complex to set-up and use. There is a real need for a product that will overcome these deficiencies.

OBJECTS AND ADVANTAGES

The principal object of this invention is to provide hunters and other gun users with an inexpensive, portable, compact, simple and yet effective system for target practice and sighting-in guns, especially in the field.

Other objects will become apparent from a consideration of the drawings and following description.

DESCRIPTION OF DRAWINGS

FIG. 1 is a perspective view of the target and sight-in system when erected and ready for use.

FIGS. 2, 3 and 4 are rear views showing the various parts of the system and the manner in which they are connected and fitted to each other to form the erected target system.

FIG. 5 is a rear view of the erected system with a log placed on the back support to give greater stability to the target while in use.

REFERENCE NUMERALS IN DRAWINGS

10 The erected target system
20 The target sheet, shown in place for use
30 The side support members
31 The ears on the side support members 30
40 The back support member
50 The side flap member with two slots
51 The top flap member
52 The side flap member with an ear
53 The ear on side flap 52
60 The slots on the side flap members 50 and 52 to receive the ears 31 on the side support members 30
61 The slot on side flap member 50 to receive the ear 53 on side flap member 52
64 The half circles cut into the front face member 80 for the purpose of holding the target sheet 20
70 The log used to weight the back support member 40
80 The front face of the system
90 The narrow sides of the system

DESCRIPTION AND OPERATION OF THE PREFERRED EMBODIMENT

A typical embodiment of the present invention takes the form of a corrugated cardboard carton when folded and has sufficient depth 90 and size to contain several targets 20, instruction sheets, the top flap member 51, the side support members 30 and the back support member 40. The side flap members 50 and 52 come together over top flap member 51 and back support member 40 with ear 53 fitted into slot 61. The side support members 30 are folded in over back support member 40 before it is folded under the side flap members and 52. When all flaps and support members are opened up, it will be apparent from FIGS. 2 and 3 that the whole embodiment as pictured in the drawings can be cut from a single sheet of corrugated cardboard.

To erect the system the side flap members 50 and 52 and the back flap member 40 are opened and the contents are removed. The side flap members 50 and 52 are closed over top flap member 51 and ear 53 is fitted into slot 61. Side support members 30 are unfolded and ears 31 are fitted into slots 60. A target sheet 20 is fitted on the front of system 10 under target holders 64. A weight like log 70 can then be placed on back support member 40 to stabilize the target system when set in place for use. A log is pictured because it can be readily found in the field where the present system can be used most advantageously.

RAMIFICATIONS AND SCOPE

While the above description is very specific, it will be readily apparent that many variations are possible without departing from the spirit and scope of the invention. For example, corrugated cardboard is a suitable structural material for the system but any material which will stand upright when ready for use, can be folded in the appropriate places, and can be readily penetrated by pellets as small as a BB and yet won't collapse or disintegrate excessively when hit with a projectile from a powerful hunting rifle would be suitable. Plastics and ordinary cardboard of appropriate structural strength are examples of other materials that can be used. Biodegradable forms of these materials are preferred. A suitable depth of the folded carton as illustrated is approximately 0.5 inches but can be varied in either direction as long as it is (1) deep enough to hold (a) a desired number of target and instruction sheets, (b) the parts of the system when folded in under the side flap members 50 and 52 and (c) when erected, connectors such as ears 31 on the side support members 30 and (2) not so deep that material or space is wasted.

There are also many ways to shape the side support members 30 or connect them to the side flap members 50 and 52 to erect the target system. The front face member 80 of the carton should preferably be large enough to hold a standard thirteen-inch square target sheet with sufficient height when erected to permit the placing of a weight on the back support member 40 below the bottom of the target 20 to minimize the chance that a bullet will strike the weight. However, the size of the target and therefore the front face of the target system can be adjusted accordingly. The back support member 40 should be deep enough to hold a weight and provide enough support to keep the erected system from falling over easily when the target is hit by a bullet. As pictured its depth is approximately one-half of the height of the standing target system. Obviously these dimensions can also be varied considerably as long the target can stand and stay erect during use most often when weighted. The side support members 30 should preferably be sized to tilt the assembled target slightly back from the vertical to give greater stability to the system in the standing position. Here too considerable variation is possible.

In another variation the side flap members can fold under the top flap and back support members and the top flap and back support members can interlock to form a completed package. In this embodiment the top flap members should be long enough to overlap the back support member and means be provided similar to that illustrated in the drawings on the side flap members to interlock the top and back support members.

As designed the system is most conveniently used when a hunter desires to sight his gun when out in the field away from a target range. However, it can also be used for target practice under the same or any other circumstance at the convenience of the user. As long as the area behind the target is clear or safe to fire into, the system provides an inexpensive, lightweight, reliable and convenient way to sight-in a gun or get some target practice. In any case the scope of the invention should measured not by the embodiments illustrated or specific terms used but only by the legally enforceable scope of the appended claims.

I claim:

1. A portable, reusable, compact package capable of opening up and reconnecting to form an upright free-standing target and sight-in system comprising a front face member capable of holding a target, a back support member connected to the lower end of the said front face member, a top flap member connected to the top of the said front face member, two flaps connected to the sides of the said front face member, and means to connect said back support member to the said other members and hold the said front face member in a substantially upright position when the system is set up to function as a target, said back support member, said top flap member and said means are all designed to fold under said side flap members which connect to each other to form a package capable of holding target and instruction sheets when not opened up and erected for use.

2. The package of claim 1 wherein the entire package is cut from one sheet of corrugated cardboard.

3. The package of claim 1 wherein the back support member is deep enough, when the package is opened and the system is erected, to hold a weight and provide enough support to keep the erected system from falling over easily during use.

4. The package of claim 1 opened up and erected with the back support member connected and said member capable of holding a target comprises cutouts under which said target is inserted.

* * * * *